US010575385B2

(12) United States Patent
Stuby, Jr. et al.

(10) Patent No.: US 10,575,385 B2
(45) Date of Patent: Feb. 25, 2020

(54) SENSOR ELEMENT FOR A LOCAL LUMINAIRE AREA CONTROL SYSTEM

(71) Applicant: TE CONNECTIVITY CORPORATION, Berwyn, PA (US)

(72) Inventors: Richard George Stuby, Jr., New Tripoli, PA (US); Matthew Edward Mostoller, Hummelstown, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 16/266,280

(22) Filed: Feb. 4, 2019

(65) Prior Publication Data

US 2019/0350065 A1 Nov. 14, 2019

Related U.S. Application Data

(60) Provisional application No. 62/670,098, filed on May 11, 2018.

(51) Int. Cl.

| | |
|---|---|
| ***H05B 37/02*** | (2006.01) |
| ***F21V 23/06*** | (2006.01) |
| ***F21V 23/04*** | (2006.01) |
| ***F21W 131/103*** | (2006.01) |
| ***H01R 13/05*** | (2006.01) |
| ***F21V 23/00*** | (2015.01) |

(52) U.S. Cl.

CPC ..... *H05B 37/0227* (2013.01); *F21V 23/002* (2013.01); *F21V 23/006* (2013.01); *F21V 23/045* (2013.01); *F21V 23/0471* (2013.01); *F21V 23/06* (2013.01); *H01R 13/052* (2013.01); *H05B 37/0218* (2013.01); *H05B 37/0272* (2013.01); *F21W 2131/103* (2013.01)

(58) Field of Classification Search

None

See application file for complete search history.

(56) References Cited

U.S. PATENT DOCUMENTS

| | | | | |
|---|---|---|---|---|
| 2012/0139426 | A1* | 6/2012 | Ilyes | F21V 23/02 315/152 |
| 2013/0040471 | A1* | 2/2013 | Gervais | F21V 23/0464 439/56 |
| 2017/0336061 | A1 | 11/2017 | Riedel et al. | |
| 2018/0049291 | A1 | 2/2018 | Xu et al. | |
| 2018/0092186 | A1 | 3/2018 | Stuby, Jr. | |

OTHER PUBLICATIONS

International Search Report, International Application No. PCT/IB2019/053619, International Filing Date, May 11, 2019.

* cited by examiner

*Primary Examiner* — Jany Richardson

(57) ABSTRACT

A sensor element for a luminaire local area (LLA) control system includes a receptacle connector, a lighting sensor connector, and an environmental sensor connector arranged in a connector stack coupled to each other and stacked on a light fixture. The receptacle connector includes power contacts for electrical connection with power wires for powering the light fixture. The lighting sensor connector is separate and discrete from the receptacle connector and includes a photocontrol component for sensing an ambient light exterior of the sensor element. The environmental sensor connector is separate and discrete from the lighting sensor connector and includes an environmental sensor component for sensing an environmental characteristic other than ambient light exterior of the sensor element for use by the LLA control system.

20 Claims, 4 Drawing Sheets

SENSOR ELEMENT FOR A LOCAL LUMINAIRE AREA CONTROL SYSTEM

CROSS REFERENCE TO RELATED APPLICATIONS

This application claims benefit to U.S. Provisional Application No. 62/670,098 filed May 11, 2018, titled "SENSOR ELEMENT FOR A LOCAL LUMINAIRE AREA CONTROL SYSTEM", the subject matter of which is herein incorporated by reference in its entirety.

BACKGROUND OF THE INVENTION

The subject matter herein relates generally to a local luminaire area control system for outdoor lighting control.

On outdoor lighting, notably street lights and parking lot lights, photocontrol components and the corresponding mating receptacles are typically used to turn the lights on and off based upon the ambient light from the sun. Some light fixtures support dimming to variably control the light fixture based on the ambient light levels, time of day. There is a trend to provide programmable functions to the light fixtures based on sensors and programmable controls other than ambient light, such as, detected nearby pedestrian motion. To accommodate these functions, the lighting control receptacles provide both a light sensor and one or more environmental sensors in a sensor device on the light fixture. Different control systems require different mixes of functionality necessitating multiple product configurations having a different arrangement of sensors in the sensor device. When a different configuration is needed or desired a different sensor device is needed to replace the existing sensor device.

A need remains for a sensor element that allows easy control and modification of sensor components in a sensor device.

BRIEF DESCRIPTION OF THE INVENTION

In one embodiment, a sensor element for a local luminaire area (LLA) control system is provided including a receptacle connector, a lighting sensor connector, and an environmental sensor connector arranged in a connector stack coupled to each other and stacked on a light fixture. The receptacle connector includes a receptacle connector housing having a base configured to be mounted to the light fixture and a receptacle connector mating interface opposite the base. The receptacle connector holds power contacts for electrical connection with power wires for powering the light fixture. The lighting sensor connector is separate and discrete from the receptacle connector and includes a lighting sensor connector housing having a base configured to be mounted to the receptacle connector mating interface. The lighting sensor connector has a lighting sensor connector mating interface opposite the base. The lighting sensor connector has a photocontrol component for sensing an ambient light exterior of the sensor element for use by the LLA control system for controlling the light fixture. The environmental sensor connector is separate and discrete from the lighting sensor connector including an environmental sensor connector housing having a base configured to be mounted to the lighting sensor connector mating interface. The environmental sensor connector has an environmental sensor component for sensing an environmental characteristic other than ambient light exterior of the sensor element for use by the LLA control system.

In another embodiment, a sensor element for a local luminaire area (LLA) control system is provided including a receptacle connector including a receptacle connector housing having a base configured to be mounted to a light fixture and a receptacle connector mating interface opposite the base. The receptacle connector holds power contacts for electrical connection with power wires for powering the light fixture being twist-lock power contacts. The sensor element includes a lighting sensor connector separate and discrete from the receptacle connector. The lighting sensor connector includes a lighting sensor connector housing having a base configured to be mounted to the receptacle connector mating interface and a lighting sensor connector mating interface opposite the base. The lighting sensor connector has a photocontrol component for sensing an ambient light exterior of the sensor element and twist-lock power contacts twist-lock coupled to the twist-lock power contacts of the receptacle connector for controlling the light fixture based on the sensed ambient light by the photocontrol component. The sensor element includes an environmental sensor connector separate and discrete from the lighting sensor connector. The environmental sensor connector includes an environmental sensor connector housing having a base configured to be mounted to the lighting sensor connector mating interface. The environmental sensor connector has an environmental sensor component for sensing an environmental characteristic other than ambient light exterior of the sensor element and generating environmental sensor data relating to the sensed environmental characteristic. The receptacle connector, the lighting sensor connector and the environmental sensor connector are arranged in a connector stack coupled to each other and stacked on the light fixture.

In a further embodiment, a sensor element for a local luminaire area (LLA) control system is provided including a receptacle connector, a sensor connector and a capping connector arranged in a connector stack configured to be stacked on a light fixture. The receptacle connector includes a receptacle connector housing having a base configured to be mounted to a light fixture and a receptacle connector mating interface opposite the base. The receptacle connector holds power contacts for electrical connection with power wires for powering the light fixture and mating contacts at the receptacle connector mating interface. The sensor connector is separate and discrete from the receptacle connector and includes a sensor connector housing having a base configured to be mounted to the receptacle connector mating interface and a sensor connector mating interface opposite the base. The sensor connector has a sensor component for sensing an environmental characteristic exterior of the sensor connector. The sensor connector has lower contacts at the base being electrically coupled to the mating contacts of the receptacle connector and upper contacts at the sensor connector mating interface. The capping connector is separate and discrete from the sensor connector and has a capping connector housing having a base configured to be mounted to the sensor connector mating interface. The capping connector covers the sensor connector mating interface and the upper contacts.

DETAILED DESCRIPTION OF THE INVENTION

Figure 1:
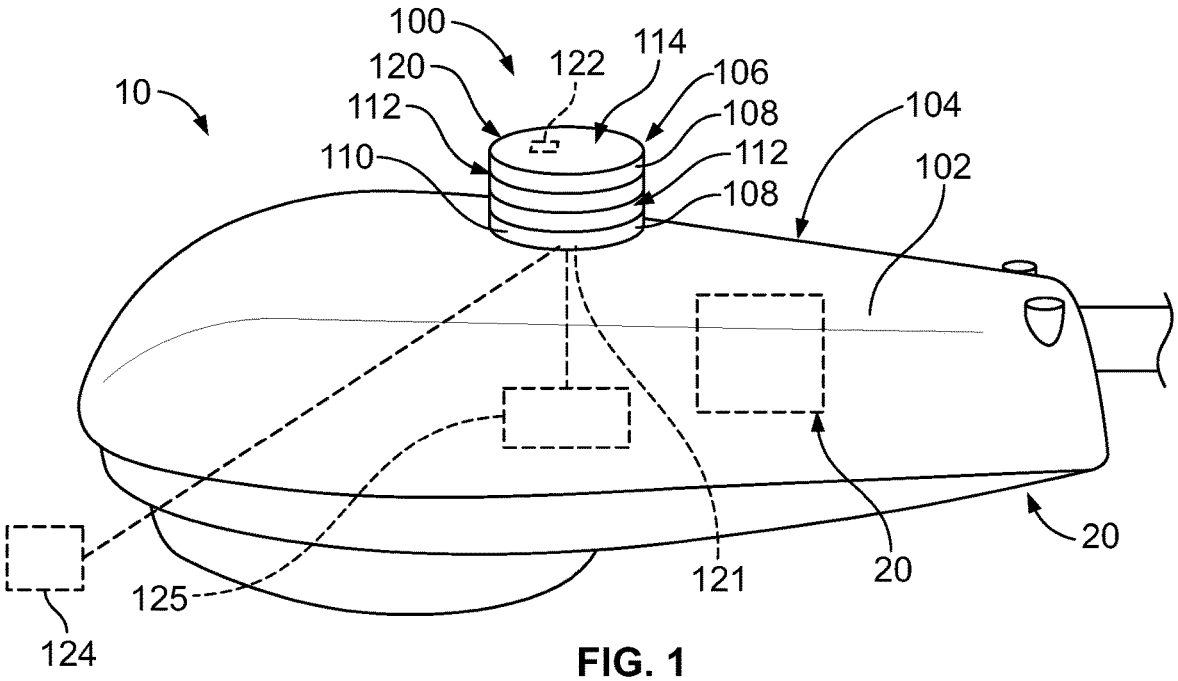
FIG. 1 illustrates a local luminaire area (LLA) control system having a sensor element formed in accordance with an exemplary embodiment.

FIG. 1 illustrates a local luminaire area (LLA) control system 10 formed in accordance with an exemplary embodiment. The LLA control system 10 includes a sensor element 100 operably coupled to a light fixture control circuit 20 for controlling a light fixture 104. The sensor element 100 is mounted to a housing 102 of the light fixture 104, such as a roadway light, a parking lot light, a street light, and the like, or to another component, such as the pole or other structure supporting the light fixture 104, or to another component unassociated with the light fixture, such as a parking meter, a telephone pole or another structure. The sensor element 100 is used to deploy sensing, actuation and/or control solutions for public utility, municipality and/or commercial management systems, such as a Smart City or a Smart Grid infrastructure. The sensor element 100 provide sensing, actuation and/or control of the light fixture 104 for energy management and/or security functions. In an exemplary embodiment, the light fixture 104 and/or the sensor element 100 may be networked within the LLA control system 10 by means of wireless communication with each other and/or with one or more remote monitoring devices and/or with a central monitoring system (e.g., using a star network, point-to-point network, mesh network, bus network, and the like).

The sensor element 100 includes a connector stack 106 having a plurality of separate and discrete connectors 108 coupled together to form the connector stack 106. The connector stack 106 has more than two connectors 108, each serving a different function. For example, the connectors 108 may hold different sensors for sensing different environmental characteristics exterior of the sensor element 100. Optionally, one or more of the connectors 108 may hold a communication module for communicating with each other, with a communication device in the light fixture 104 or with a communication device remote from the light fixture 104. Optionally, one or more of the connectors 108 may include power contacts for controlling one or more lighting functions of the light fixture 104. Optionally, one or more of the connectors 108 may be sealed to the environment to seal the connector stack 106. In various embodiments, the connectors 108 are interchangeable within the connector stack 106 to change the functionality of the sensor element 100. Different sensor elements may include different combinations of connectors 108 to perform different functions or tasks, such as monitoring or sensing different environmental characteristics. The connectors 108 may have common mating interfaces at the upper and/or lower surfaces for mating and stacking in any arrangement. The connectors 108 may have common shapes, dimensions, and the like for stacking. For example, the connectors 108 may be cylindrical having substantially equal outer diameters for forming a uniformly cylindrical sensor element; however, other shapes are possible in alternative embodiments.

In an exemplary embodiment, one or more of the connectors 108 holds sensors that are used to control the light fixture 104, such as for turning the light fixture 104 on or off depending upon light levels, for dimming control of the light fixture 104, or for controlling other functions. For example, the sensor may be a photocontrol component configured to monitor and the sense ambient light levels around the sensor element 100, such as a photocell or light sensor used to detect ambient light from the sun. Other types of sensors may be used to control the lighting operation of the light fixture 104, such as object identification sensors, proximity sensors, occupancy sensors, motion sensors, timing sensors, and the like for turning the light fixture ON/OFF and/or dimming control based on presence of a person or object. In an exemplary embodiment, connectors 108 having other types of sensors may be used within the connector stack 106, such as pollution sensors, noise sensors, such as to monitor for a gun shot, weather sensors, such as for measuring barometric pressure, humidity, temperature, and the like, or other types of sensors. The sensors may be used for other functions other than controlling the light fixture 104, such as remote monitoring of the environmental surroundings of the housing 102, such as for parking monitoring, for street flow activity monitoring, or other functions.

In an exemplary embodiment, the connectors 108 of the sensor element 100 include a receptacle connector 110, one or more intermediate connectors 112 and a capping connector 114 arranged in the stacked configuration. The receptacle connector 110 defines a bottom or base unit for mounting to the light fixture 104. The receptacle connector 110 may hold power contacts 116 coupled to power wires of the light fixture 104, such as for controlling lighting of the light fixture 104 and/or for powering the sensor element 100.

In various embodiments, the intermediate connectors 112 are configured to be coupled to the receptacle connector 110 and are configured to be coupled to other intermediate connectors 112 to allow interchangeability of the intermediate connectors 112. For example, the bottoms of the intermediate connectors 112 may have a mating interface configured to be coupled to the receptacle connector 110. The tops of the intermediate connectors 112 may have a mating interface identical to the mating interface of the receptacle connector 110 to accept mating of other intermediate connectors 112. In other various embodiments, one of the intermediate connectors 112 defines a base intermediate connector configured to be mated to the receptacle connector 110, but such base intermediate connector may include a different mating interface than the receptacle connector 110, such as a simpler mating interface (for example, a mating interface that does not need to be mated to power contacts), and all of the other intermediate connectors, also referred to as interchangeable intermediate connectors have simpler mating interfaces for mating with each other and with the base intermediate connector. The intermediate connectors 112 are interchangeable to change the functionality of the sensor element 100. The intermediate connectors 112 include sensors for sensing the environmental characteristics exterior of the sensor element 100. The intermediate connector 112 houses or surrounds the corresponding sensor(s), such as to provide environmental protection for the sensor (s). Optionally, the intermediate connectors 112 include contacts, such as signal contacts, power contacts, and the like exposed at the lower and upper mating surfaces for interfacing with other connectors (for example, the receptacle connector 110, other intermediate connectors 112 and the capping connector 114).

In an exemplary embodiment, the capping connector 114 defines the top or cap for the connector stack 106. The capping connector 114 may be used for sealing the connector stack 106 from the environment. For example, the capping connector 114 does not include exposed contacts at the upper surface. Rather, the capping connector 114 is used to cover the contacts at the upper surface of the top-most intermediate connector 112. In an exemplary embodiment, the capping connector 114 may have a seal at the interface with the intermediate connector 112 directly below the capping connector 114 to provide an environmental seal at the mating interface therebetween. Optionally, the intermediate connectors 112 may have seals at the mating interfaces with other connectors 108 to provide environmental seals therebetween.

In an exemplary embodiment, the receptacle connector 110 is a twist-lock receptacle connector 110 having twist-lock socket power contacts 116 electrically connected to the power wires, such as being ANSI C136.x compliant power contacts. The receptacle connector 110 may include signal contacts in addition to the power contacts 116 for additional control and/or data transfer with other elements, such as in the light fixture 104 and or with the intermediate connectors 112. In an exemplary embodiment, the intermediate connectors 112 are twist-lock intermediate connectors 112, such as being an ANSI C136.x compliant connectors. For example, the intermediate connectors 112 may include twist-lock blade power contacts 118 extending from the bottom configured to be electrically connected to the twist-lock socket power contacts 116 of the receptacle connector 110. In various embodiments, the intermediate connectors 112 may include twist-lock socket power contacts 116 at the upper mating surface, electrically connected with the corresponding twist-lock blade power contacts 118 at the lower mating surface. In this manner, each of the intermediate connectors 112 are configured to be mated to any other intermediate connector 112 or the receptacle connector 110 by a twist-lock type of connection. The power contacts 116, 118 may be high voltage power contacts. Other types of contacts may be provided at the mating interfaces for a direct, physical electrical connection across the mating interfaces between the connectors 110, 112. The connectors 110, 112 may be other types of connectors other than twist-lock connectors. The connectors 110, 112 may include other types of power contacts 116, 118 other than twist-lock contacts or may not include any contacts but rather be contactless connections.

In an exemplary embodiment, at least one of the intermediate connectors 112 and/or the capping connector 114 is used for data communication and defines a communication connector 120 configured for communication of data from the sensor element 100 to a light fixture communication module 125 in the light fixture 104 and/or to a remote communication device 124. In various embodiments, the communication connector 120 is configured for contactless communication; however, the communication connector 120 may be configured to communicate through signal contacts and/or wires within the system. In the illustrated embodiment, the communication connector 120 is the capping connector 114. However, in another exemplary embodiment, the communication connector 120 is one of the intermediate connectors 112. The communication connector 120 includes a communication module 122 for data communication. For example, the communication module 122 may include one or more processors for data communication. The communication module 122 may include an antenna for contactless and wireless communication with another intermediate connector 112 and/or for contactless and wireless communication with the light fixture communication module 125 and/or for contactless and wireless communication with the remote communication device 124; however, the communication module 122 may communicate by other means in alternative embodiments.

In an exemplary embodiment, the communication module 122 communicates wirelessly, such as through digital wireless signals, infrared signals, capacitive communication, inductive communication or by other types of contactless and wireless communication. Data may be transmitted from the communication connector 120 to the light fixture 104 or the remote device without the need for contacts or wires. The remote communication device 124 may be remote from the light fixture 104, such as on the ground or at a central communication location for control of the light fixture 104 and/or for monitoring the environment around the light fixture 104, such as pedestrian traffic, vehicle traffic, parking, or other environmental factors.

In an exemplary embodiment, the communication connector 120 is configured for contactless communication of sensor data from the sensors in the sensor element 100. For example, the sensor data may relate to one or more of the environmental characteristics sensed by the sensors in the intermediate connectors, such as the level of ambient light exterior of the sensor element 100 when the sensor is a photocontrol component or another type of environmental characteristic when another type of sensor component is used. Optionally, the sensor data may be processed by the sensor element 100 prior to being communicated by the communication connector 120. Alternatively, the raw sensor data may be communicated by the communication connector 120. The sensor data may be used by the LLA control system 10 to control operation of the light fixture 104, such as for turning on or off the light fixture 104 and/or dimming control of the light fixture 104. The sensor data may be used by the LLA control system 10 to control functions of other components remote from the light fixture 104, such as by communicating the sensor data back to a central system.

In an exemplary embodiment, the communication connector 120 is configured for contactless communication of identifying data relating to an identifying characteristic of the sensor element 100. The identifying characteristic may be based on a sensing capability of the sensor element 100 or for one or more of the components of the sensor element 100, such as one or more of the intermediate connectors 112. For example, the sensing capability may relate to the type of sensor component or sensor components contained in the intermediate connectors 112 to identify the type of sensing that the sensor element 100 is able to perform any type of environmental characteristic configured to be sensed by the sensor element 100. For example, the sensing capability may relate to ambient light level detection, occupancy or motion detection, weather detection, pollution detection, position detection or another type of sensing capability depending on the type of sensor contained within the sensor element 100. The identifying characteristic may relate to a brand of manufacture for compliance verification within the LLA control system 10. The identifying characteristic may be a unique identifier of the sensor element 100, such as a product code, a barcode, a part number, an identification number, and the like. The identifying data is used for validation and verification that the sensor element 100, or the various components thereof, are able to be used within the LLA control system 10. The identifying data is used by the LLA control system 10 to develop the system architecture from a central system for controlling the Smart City system. The identifying data is used by the light fixture control system to control the sensor element 100. For example, control signals may be communicated back to the sensor element 100 to control one or more operations of the sensor element 100 based on the sensing capabilities of the sensor element 100. The sensor element 100 may be updated or upgraded based on the identifying data.

Figure 2:
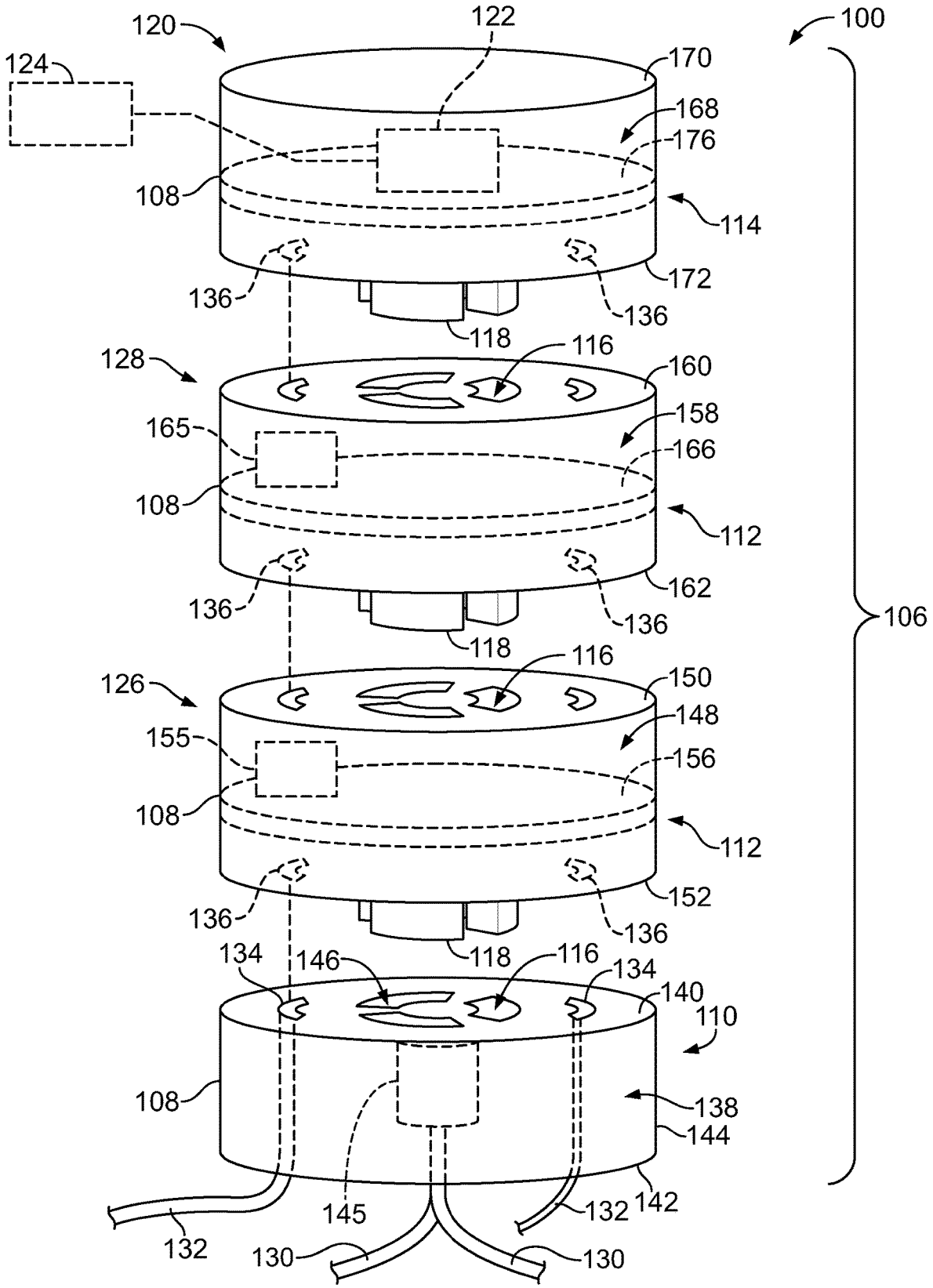
FIG. 2 is a schematic view of the sensor element formed in accordance with an exemplary embodiment.

FIG. 2 is an exploded view of the sensor element 100 formed in accordance with an exemplary embodiment showing the receptacle connector 110, two of the intermediate connectors 112 and the capping connector 114 poised for mating with each other. It is realized that any number of connectors 108 may be used in the connector stack 106, such as by increasing or decreasing the number of intermediate connectors 112. It is also realized that the connector stack 106 may be provided without the capping connector 114, such as by using one of the intermediate connectors 112 as the upper-most connector. Optionally, a cover (not shown) or other housing element may be provided to protect the upper-most connector or any of the other connectors (for example, an outer housing around the entire connector stack 106.

In an exemplary embodiment, one of the intermediate connectors 112 is used for light sensing ambient light exterior of the sensor element 100 and may be referred to hereinafter as a lighting sensor connector 126 and another of the intermediate connectors 112 is used for sensing an environmental characteristic other than ambient light exterior of the sensor element 100 and may be referred to hereinafter as an environmental sensor connector 128. Optionally, multiple environmental sensor connectors 128 may be used in the connector stack 106 for sensing different environmental characteristics. In the illustrated embodiment, the lighting sensor connector 126 is coupled to the receptacle connector 110 and the capping connector 114 is coupled to the environmental sensor connector 128. In the illustrated embodiment, the capping connector 114 defines the communication connector 120 and includes the communication module 122; however, the communication module 122 may be received in different connectors 108, such as in the lighting sensor connector 126, the environmental sensor connector 128 and/or the receptacle connector 110 having such connector also defining the communication connector.

In an exemplary embodiment, the receptacle connector 110 includes the socket power contacts 116, each of the intermediate connectors 112 include both the socket power contacts 116 and the blade power contacts 118 and the capping connector 114 includes the blade power contacts 118 for electrically connecting the various connectors 108. Other arrangements and/or types of contacts may be provided in alternative embodiments. Optionally, seals (not shown) may be provided between the connectors 108 to seal the sensor element 100 from environmental containments such as water, debris, and the like. The capping connector 114 does not include exposed power contacts 116 and thus is sealed at the top.

The sensor element 100 may include power wires 130 extending from the receptacle connector 110. The power wires 130 are terminated to corresponding power contacts 116 of the receptacle connector 110. The power wires 130 may be power in or power out wires bringing power to the sensor element 100 from a power source or bringing power from the power contacts 116 to another component, such as the light or a driver board for the light of the light fixture 104. In other various embodiments, the sensor element 100 does not include the power wires 130 extending to/from the receptacle connector 110, but rather the power wires 130 may extend to other components in the light fixture 104.

The sensor element 100 may additionally or alternatively include signal wires 132 extending from the receptacle connector 110. The signal wires 132 may be electrically connected to signal contacts 134 of the receptacle connector 110. The signal wires 132 may be electrically connected to other components, such as part of the light fixture control circuit 20 in the light fixture 104. The signal wires 132 may transmit data to or from the light fixture control circuit 20 for data communication with the sensor element 100. The signal wires 132 may be electrically connected to one or more other components, such as a control module for controlling the operation of the light fixture 104 or a communication module in the light fixture 104.

Optionally, as in the illustrated embodiment, the intermediate connectors 112 may include signal contacts 136 at the mating interface for electrical connection to corresponding signal contacts 134 of the receptacle connector 110. The receptacle connector 110 and the intermediate connectors may be ANSI C136.xx compliant connectors, such as a five position version having three power contacts 116,118 and two signal contacts 134, 136 or a seven position version having three power contacts 116, 118 and four signal contacts 134, 136; however, other types of connectors may be used in alternative embodiments. The signal contacts 134, 136 are directly mated together at the mating interface between the receptacle connector 110 and the intermediate connector 112. The signal contacts 134, 136 may be leaf spring contacts or other types of contacts. The signal contacts 136 of the lighting sensor connector 126 are directly mated with the signal contacts 136 of the environmental sensor connector 128 at the corresponding mating interface. The signal contacts 134 transmit data signals between the various connectors 108. Such data may be communicated to the communication connector 120 and then transmitted wirelessly from the sensor element 100, such as to the remote communication device 124. In alternative embodiments, rather than using the contacts 134, 136, the data may be communicated contactlessly, such as using communication modules 122 in each of the connectors 108.

The receptacle connector 110 includes a receptacle connector housing 138 extending between a top 140 and a bottom 142 opposite the top 140. The bottom 142 defines the base of the connector stack 106 and is configured to be secured to the fixture housing 102 or another component. The receptacle connector 110 includes a side wall 144 between the top 140 and the bottom 142. The housing 138 holds the power contacts 116 and the signal contacts 134. In an exemplary embodiment, the housing 138 holds a circuit board or other circuit components defining a power management circuit 145. For example, the power management circuit 145 may include a surge protection component, an overvoltage protection component, an EMI filter and/or other components. The circuit board may hold the communication module 122. Optionally, such components may be entirely contained within the housing 138 and protected from the environment by the housing 138.

In an exemplary embodiment, the power contacts 116 are held in contact channels 146 within the housing 138. Optionally, the contact channels 146 are curved slots or openings in the housing 138 extending between the top 140 and the bottom 142. In an exemplary embodiment, the receptacle connector 110 is cylindrical shaped, such as to allow easy rotation of the intermediate connector 112 relative to the receptacle connector 110 for twist-lock mating. However, the receptacle connector 110 may have other shapes in alternative embodiments.

In an exemplary embodiment, the receptacle connector 110 includes at least one securing feature used to secure the intermediate connector 112 relative to the receptacle connector 110. For example, the receptacle connector 110 may include a clip or a flange to secure the intermediate connector 112 to the receptacle connector 110. The securing feature may allow rotation of the intermediate connector 112 relative to the receptacle connector 110 when engaged. Other fastening methods that secure the intermediate connector 112 to the receptacle connector 110 may be employed, which may allow rotation of intermediate connector 112 relative to receptacle connector 110. In other various embodiments, the interaction between the contacts 116 is used to secure the intermediate connector 112 to the receptacle connector 110.

The lighting sensor connector 126 includes a housing 148 extending between a top 150 and a bottom 152 opposite the top 150. The bottom 152 may define the mating interface and is configured to be secured to the receptacle connector 110. In other embodiments, sides of the housing 148 or other securing features may be secured to the receptacle connector 110. In an exemplary embodiment, the lighting sensor connector 126 is cylindrical shaped, such as to allow easy rotation of the lighting sensor connector 126 relative to the receptacle connector 110 for twist-lock mating. However, the lighting sensor connector 126 may have other shapes in alternative embodiments.

The housing 148 holds the socket power contacts 116 at the top 150, the blade power contacts 118 at the bottom 152 and the signal contacts 136 at the top 150 and the bottom 152. The housing 148 may hold the communication module 122. The housing 148 holds a photocontrol component 155. In an exemplary embodiment, the housing 148 holds a circuit board 156 and various components are mounted to the circuit board 156. For example, the contacts 116, 118, signal contacts 136, communication module 122 and/or the photocontrol component 155 may be mounted to the circuit board 156. The blade power contacts 118 extend from the bottom 152 and the signal contacts 136 are provided at the bottom 152 for mating with the socket power contacts 116 and the signal contacts 134, respectively, of the receptacle connector 110. The contacts 118, 136 may be arranged generally around a central axis, however the contacts 118 and/or 136 may be at different locations in alternative embodiments. Optionally, the contacts 118 may be curved and fit in the curved contact channels 146 in the receptacle connector 110 to mate with corresponding curved power contacts 116. In an exemplary embodiment, the lighting sensor connector 126 may be twisted or rotated to lock the contacts 118 in the receptacle connector 110, such as in electrical contact with the contacts 116. For example, the contacts 118 may be twist-lock contacts that are initially loaded into the contact channels 146 in a vertical direction and the lighting sensor connector 126 is then rotated, such as approximately 35 degrees, to lock the contacts 118 in the connector 110. Other types of mating arrangements between the contacts 118 and the contacts 116 are possible in alternative embodiments.

The photocontrol component 155 is used for sensing ambient light and is used to control operation of the light fixture 104, such as for turning the light fixture 104 on or off depending upon light levels or for dimming control of the light fixture 104. For example, the photocontrol component 155 may be a photocell photocell or light sensor used to detect ambient light from the sun. Optionally, the photocontrol component 155 may be mounted to the circuit board 156 and the circuit board 156 may include componentry for signal conditioning of the signal from the photocontrol component 155. For example, the circuit board 156 may have control circuitry for controlling operation of the light fixture 104, such as including a daylight or nighttime control circuit, a timer circuit, a dimming circuit, and the like. Data from the photocontrol component 155 may be transmitted through the signal contacts 136 across the mating interface with the receptacle connector 110 or another intermediate connector 112. Alternatively, data from the photocontrol component 155 may be transmitted through the contactless communication module 122 across the mating interface for control of the light fixture 104.

The environmental sensor connector 128 includes a housing 158 extending between a top 160 and a bottom 162 opposite the top 160. The bottom 162 may define the mating interface and is configured to be secured to the lighting sensor connector 126. In other embodiments, sides of the housing 158 or other securing features may be secured to the lighting sensor connector 126 and/or receptacle connector 110. In an exemplary embodiment, the environmental sensor connector 128 is cylindrical shaped, such as to allow easy rotation of the environmental sensor connector 128 relative to the lighting sensor connector 126 for twist-lock mating thereto. However, the environmental sensor connector 128 may have other shapes in alternative embodiments.

The housing 158 holds the socket power contacts 116 at the top 160, the blade power contacts 118 at the bottom 162 and the signal contacts 136 at the top 160 and the bottom 162. The housing 158 may hold the communication module 122. The housing 158 holds an environmental sensor component 165. In an exemplary embodiment, the housing 158 holds a circuit board 166 and various components are mounted to the circuit board 166. For example, the contacts 116, 118, signal contacts 136, communication module 122 and/or the environmental sensor component 165 may be mounted to the circuit board 166. The blade power contacts 118 extend from the bottom 162 and the signal contacts 136 are provided at the bottom 162 for mating with the socket power contacts 116 and the signal contacts 136, respectively, of the lighting sensor connector 126. The contacts 118, 136 may be arranged generally around a central axis, however the contacts 118 and/or 136 may be at different locations in alternative embodiments. Optionally, the contacts 118 may be curved and fit in the curved contact channels in the lighting sensor connector 126 to mate with corresponding curved power contacts 116. In an exemplary embodiment, the environmental sensor connector 128 may be twisted or rotated to lock the contacts 118 in the lighting sensor connector 126, such as in electrical contact with the contacts 116. For example, the contacts 118 may be twist-lock contacts that are initially loaded into the contact channels in a vertical direction and the environmental sensor connector 128 is then rotated, such as approximately 35 degrees, to lock the contacts 118 in the connector 126. Other types of mating arrangements between the contacts 118 and the contacts 116 are possible in alternative embodiments.

In an exemplary embodiment, the lower mating interface of the environmental sensor connector 128 is identical to the lower mating interface of the lighting sensor connector 126 such that the environmental sensor connector 128 and the lighting sensor connector 126 are interchangeable. Either of the connectors 126 or 128 may be coupled to the receptacle connector 110. In an exemplary embodiment, the upper mating interfaces of the environmental sensor connector 128 and the lighting sensor connector 126 are identical to each other and to the upper mating interface of the receptacle connector 110 such that any of the receptacle connector 110, the environmental sensor connector 128 or the lighting sensor connector 126 may be mated to another intermediate connector 112 or the capping connector 114.

The environmental sensor component 165 is used for sensing an environmental characteristic other than ambient light exterior of the intermediate connector 112 in the environment exterior of the intermediate connector 112. Optionally, the environmental sensor component 165 may be mounted to the circuit board 166 and the circuit board 166 may include componentry for signal conditioning of the signal from the environmental sensor component 165. Data from the environmental sensor component 165 may be transmitted through the signal contacts 136 across the mating interface with the receptacle connector 110 or the capping connector 114. Alternatively, data from the environmental sensor component 165 may be transmitted through the contactless communication module 122 across the mating interface.

In various embodiments, the environmental sensor component 165 may be a motion sensor or an object sensor configured to sense movement or presence of an object, such as a person or vehicle in a particular area. The environmental sensor component 165 may be used for parking monitoring, for street flow activity monitoring, for pedestrian monitoring, or other functions. The environmental sensor component 165 may be a position sensor, such as a GPS sensor for determining a position of the light fixture 104. The environmental sensor component 165 may be a weather detection sensor configured to detect one or more weather-related characteristics, such as barometric pressure, humidity, temperature, and the like. The environmental sensor component 165 may be a pollution sensor configured to detect particulates of one or more types of matter. The environmental sensor component 165 may be mounted to the circuit board 156. In an exemplary embodiment, the environmental sensor component 165 is electrically connected to the communication module 122 and the communication module 122 receives signals from the environmental sensor component 165 and wirelessly communicates sensor data based on the received signals from the environmental sensor component 165 with another component, such as the light fixture 104 or the remote communication device 124. In various other embodiments, data from the environmental sensor(s) may be transmitted through the signal contacts 136 across the mating interface.

The capping connector 114 includes a housing 168 extending between a top 170 and a bottom 172 opposite the top 170. The bottom 172 may define the mating interface and is configured to be secured to the environmental sensor connector 128; however, the capping connector 114 may be secured to a different intermediate connector 112 in other embodiments. Optionally, sides of the housing 168 or other securing features may be secured to the environmental sensor connector 128, the lighting sensor connector 126 and/or receptacle connector 110. In an exemplary embodiment, the capping connector 114 is cylindrical shaped, such as to allow easy rotation of the environmental sensor connector 128 relative to the environmental sensor connector 128 for twist-lock mating thereto. However, the capping connector 114 may have other shapes in alternative embodiments.

The housing 168 holds the blade power contacts 118 at the bottom 172 and signal contacts 136 at the bottom 172. In various embodiments, the housing 168 may hold the communication module 122, thus defining the communication connector 120. The housing 168 holds a circuit board 176 and various components are mounted to the circuit board 176. For example, the power contacts 118, signal contacts 136, communication module 122 and/or other components may be mounted to the circuit board 176. The blade power contacts 118 extend from the bottom 172 and the signal contacts 136 are provided at the bottom 172 for mating with the socket power contacts 116 and the signal contacts 136, respectively, of the environmental sensor connector 126. The contacts 118, 136 may be arranged generally around a central axis, however the contacts 118 and/or 136 may be at different locations in alternative embodiments. Optionally, the contacts 118 may be curved and fit in the curved contact channels in the environmental sensor connector 126 to mate with corresponding curved power contacts 116. In an exemplary embodiment, the environmental sensor connector 128 may be twisted or rotated to lock the contacts 118 in the environmental sensor connector 128, such as in electrical contact with the contacts 116. For example, the contacts 118 may be twist-lock contacts that are initially loaded into the contact channels in a vertical direction and the capping connector 114 is then rotated, such as approximately 35 degrees, to lock the contacts 118 in the connector 128. Other types of mating arrangements between the contacts 118 and the contacts 116 are possible in alternative embodiments.

In an exemplary embodiment, the communication module 122 is a transceiver configured for two-way communication. For example, data may be transmitted from the communication module 122 and received by the communication module 122. The communication module 122 may transmit data to and/or from the sensors of the intermediate connectors 112, such as data relating to light levels, dimming control of the light fixture 104, or other environmental information about the environment around the light fixture 104. Additionally, the communication module 122 may transmit data, such as identifying metadata about the connectors 108 to another communication device, such as the light fixture communication device 125 and/or the remote communication device 124. The identifying metadata may be a serial number, location coordinates or other metadata associated with the receptacle connector 110 and/or the light fixture 104. The metadata may be independent of the sensor data. The metadata may be used to control operation of the sensors, such as timing or control of operation.

In an exemplary embodiment, the communication module 122 communicates wirelessly through digital wireless signals or other types of wireless signals. For example, the communication module 122 may communicate using RF wireless communication, near-field communication (NFC), RFID, Bluetooth low energy (BLE) communication, ZigBee communication, RuBee communication, magnetic communication and the like. The communication module 122 may communicate using capacitive coupling, inductive coupling or electromagnetic fields. The communication module 122 may be closely aligned for efficient coupling. The communication module 122 may communicate using line-of-sight wireless communication, such as optical communication including infrared communication or communication using other visible or invisible light spectrums.

In an exemplary embodiment, multiple communication module 122 may be provided in the connector stack 106 (such as in each connector 108) to communicate with each other and/or with another communication device, such as the remote communication device 124 and/or the light fixture communication device 125. The remote communication device 124 may be part of a hand-held device on the ground held by an operator. The remote communication device 124 may be a central station monitoring data from multiple light fixtures. The remote communication device 124 may transmit data to the communication module 122 for remote control of the light fixture 104.

In an exemplary embodiment, the connectors 108 are backwards compatible with conventional 3-contact ANSI C136.x receptacles and with 4-7 contact ANSI receptacles.

Optionally, providing the communication module 122 in the connector stack 106 may replace some or all of the 1-4 low voltage signal contacts of conventional ANSI receptacles; however, the communication module 122 may be used in addition to the low voltage signal contacts of conventional ANSI receptacles to enhance the amount or type of data being transmitted between the connectors 108 and/or to other components. The communication module 122 may be designed to communicate with digital multiplexing capabilities or digital packet protocols for enhanced data transfer. The signals transmitted to-from the communication module 122 may be converted to DALI compliant levels or may be converted to 0-10V (standard) compliant levels. The connections to the communication devices, such as to the sensors may be through wires, terminals, connectors, printed circuit board connections, and the like.

Figure 3:
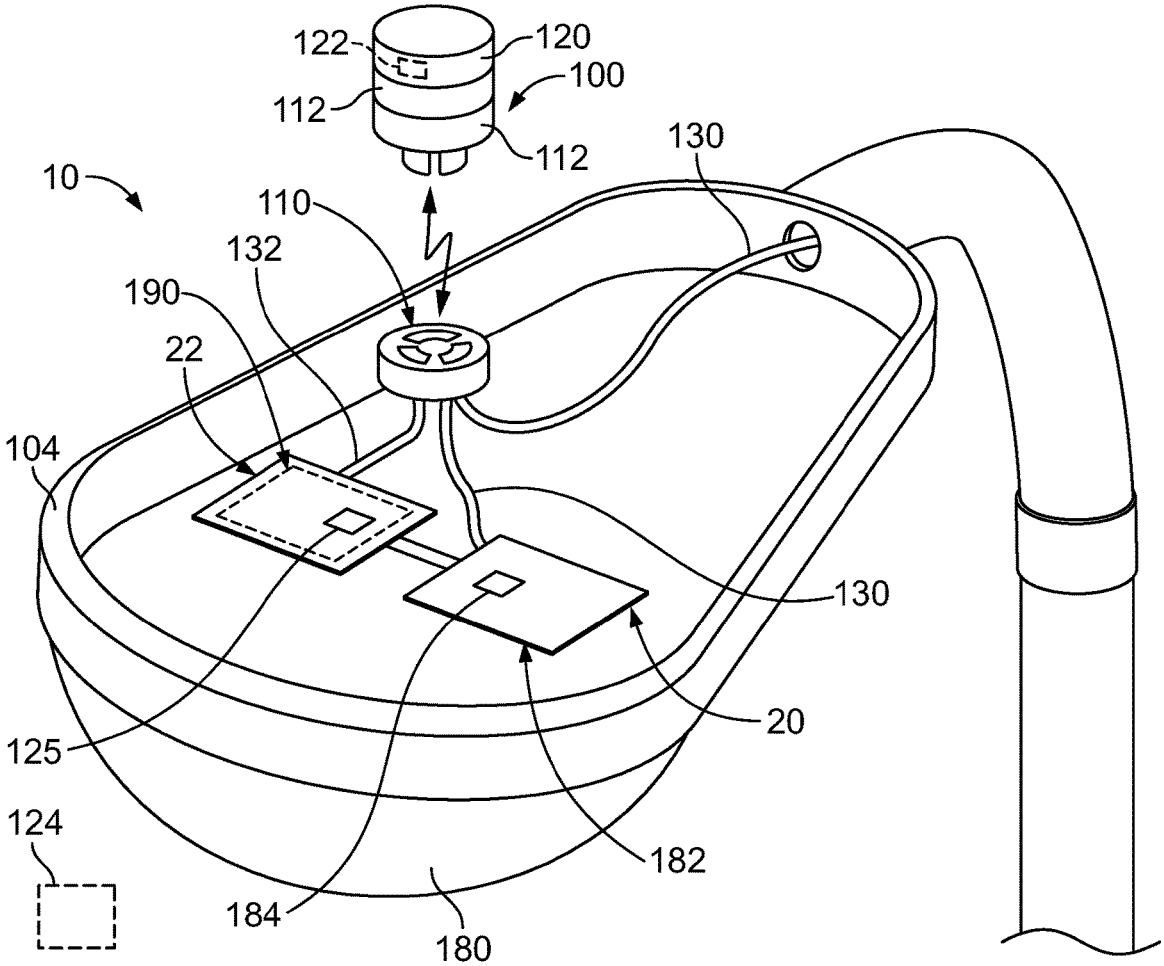
FIG. 3 is a schematic view of the sensor element within a light fixture.

FIG. 3 is a schematic view of the sensor element 100 and the light fixture control circuit 20 within the light fixture 104. The sensor element 100 includes the receptacle connector 110, the intermediate connectors 112 and the communication connector 120. The light fixture 104 includes a lighting element 180. The lighting element 180 is powered by the power wires 130. For example, the power wires 130 are connected to a light control module 22 of the light fixture control circuit 20. The power wires 130 extend to/from the receptacle connector 110 and may be electrically connected to the contacts 116 (shown in FIG. 2). The light control module 22 includes circuitry for supplying power to the lighting element 180. For example, in various embodiments, the light control module 22 includes a power driver circuit board 182. The light control module 22 may include a switch 184 for switching the power on or off. Optionally, the light control module 22 may control dimming of the lighting element 180, such as by controlling the power to the lighting element 180.

In an exemplary embodiment, the light control module 22 includes a control circuit 190, such as on a main circuit board. The control circuit 190 controls operation of the light fixture 104. For example, the control circuit 190 may control operation of the switch 184. The control circuit 190 may be connected to the power driver circuit board 182 by wires. Alternatively, the control circuit 190 may be connected to the power driver circuit board 182 wirelessly. In other various embodiments, the control circuit 190 and the power driver circuit board 182 may be on the same circuit board and connected by traces.

In an exemplary embodiment, the control circuit 190 includes the light fixture communication module 125. The control circuit 190 receives inputs from the sensor element 100, such as from the sensor contacts 136 and/or the communication connector 120, and provides outputs, such as to the power driver circuit board 182. In various embodiments, the control circuit 190 is electrically connected to the signal wires 132, which are electrically connected to the sensor element 100. In other various embodiments, the control circuit 190 has contactless communication with the communication connector 120. As such, the control circuit 190 receives data from the sensor element 100. The data may be used to control operation of the light fixture 104. The data may be used to control other functions. The data may be further transmitted to another communication device, such as the remote communication device 124, such as for parking or traffic monitoring.

The light fixture control circuit 20 is used for controlling various functions of the light fixture 104 and the control system 10. For example, the light control module 22 of the light fixture control circuit 20 is used for controlling the lighting element 180 of the light fixture 104, such as ON/OFF, dimming or other functions. The light control module 22 switches and controls power to the lighting element 180. The light fixture communication module 125 of the light fixture control circuit 20 is used for communication with the sensor element 100 and/or with the remote communication module 124.

In an exemplary embodiment, the light fixture control circuit 20 includes a circuit board having one or more circuits for controlling the operation of the LLA control system 10. The light fixture control circuit 20 may include one or more processors. Optionally, the light fixture control circuit 20 may include a central processing unit (CPU), one or more microprocessors, a graphics processing unit (GPU), or any other electronic component capable of processing inputted data according to specific logical instructions. Optionally, the light fixture control circuit 20 may include and/or represent one or more hardware circuits or circuitry that include, are connected with, or that both include and are connected with, one or more processors, controllers, and/or other hardware logic-based devices. Additionally or alternatively, the light fixture control circuit 20 may execute instructions stored on a tangible and non-transitory computer readable medium (e.g., the memory).

As used herein, the term "computer," "control circuit," "circuit," or "module" may include any processor-based or microprocessor-based system including systems using microcontrollers, reduced instruction set computers (RISC), ASICs, logic circuits, and any other circuit or processor capable of executing the functions described herein. The above examples are exemplary only, and are thus not intended to limit in any way the definition and/or meaning of the term "control circuit".

The circuit or module executes a set of instructions that are stored in one or more storage elements, in order to process input data. The storage elements may also store data or other information as desired or needed. The storage element may be in the form of an information source or a physical memory element within a processing machine.

The set of instructions may include various commands that instruct the computer, control circuit, module and/or circuit to perform specific operations such as the methods and processes of the various embodiments. The set of instructions may be in the form of a software program. The software may be in various forms such as system software or application software and which may be embodied as a tangible and non-transitory computer readable medium. Further, the software may be in the form of a collection of separate programs or modules, a program module within a larger program or a portion of a program module. The software also may include modular programming in the form of object-oriented programming. The processing of input data by the processing machine may be in response to operator commands, or in response to results of previous processing, or in response to a request made by another processing machine.

As used herein, a structure, limitation, or element that is "configured to" perform a task or operation is particularly structurally formed, constructed, or adapted in a manner corresponding to the task or operation. For purposes of clarity and the avoidance of doubt, an object that is merely capable of being modified to perform the task or operation is not "configured to" perform the task or operation as used herein. Instead, the use of "configured to" as used herein denotes structural adaptations or characteristics, and denotes structural requirements of any structure, limitation, or element that is described as being "configured to" perform the task or operation. For example, a control unit, circuit, processor, or computer that is "configured to" perform a task or operation may be understood as being particularly structured to perform the task or operation (e.g., having one or more programs or instructions stored thereon or used in conjunction therewith tailored or intended to perform the task or operation, and/or having an arrangement of processing circuitry tailored or intended to perform the task or operation). For the purposes of clarity and the avoidance of doubt, a general purpose computer (which may become "configured to" perform the task or operation if appropriately programmed) is not "configured to" perform a task or operation unless or until specifically programmed or structurally modified to perform the task or operation.

As used herein, the terms "software" and "firmware" are interchangeable, and include any computer program stored in memory for execution by a computer, including RAM memory, ROM memory, EPROM memory, EEPROM memory, and non-volatile RAM (NVRAM) memory. The above memory types are exemplary only, and are thus not limiting as to the types of memory usable for storage of a computer program.

Figure 4:
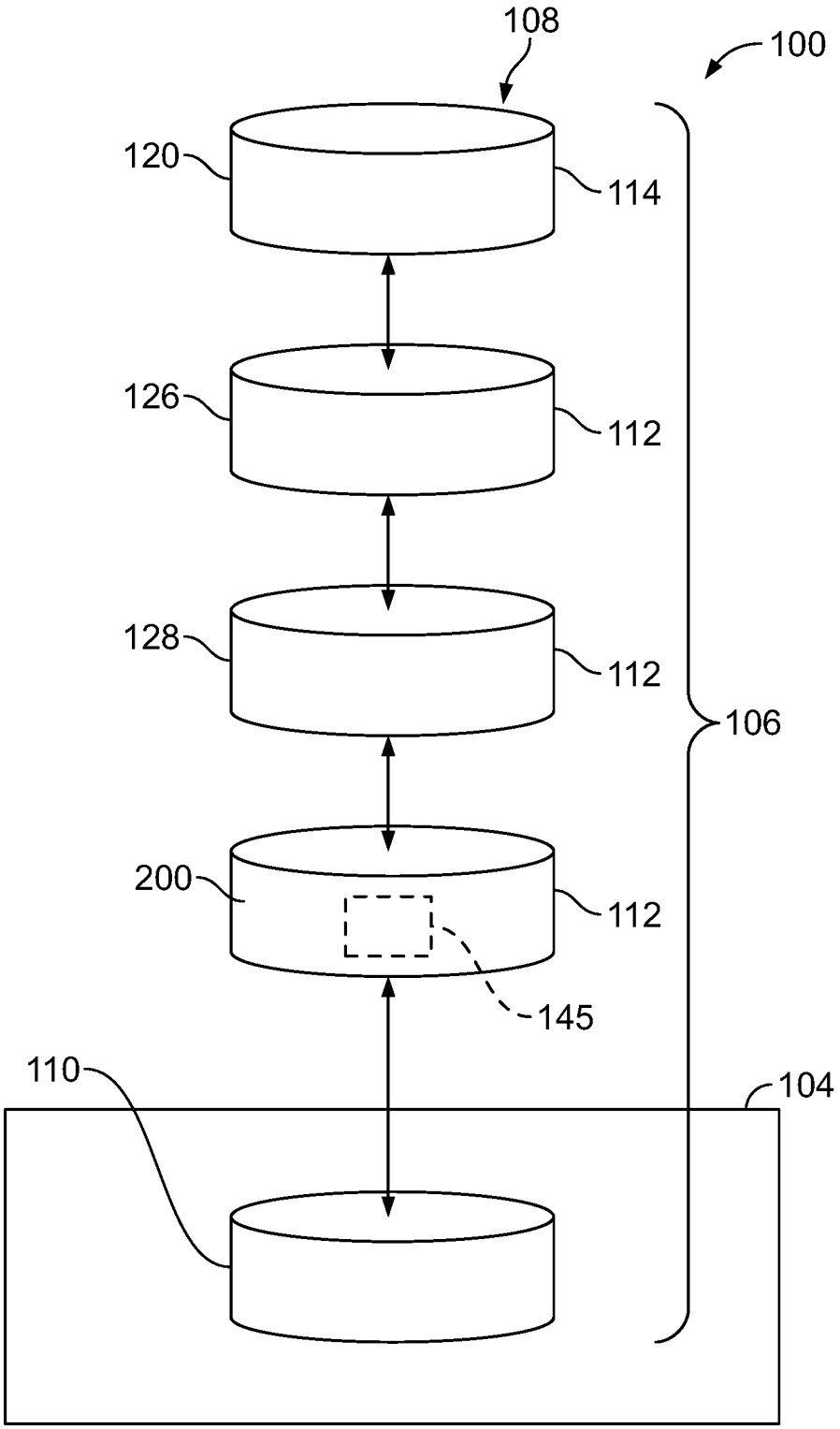
FIG. 4 is an exploded view of the sensor element formed in accordance with an exemplary embodiment.

FIG. 4 is an exploded view of the sensor element 100 formed in accordance with an exemplary embodiment showing the receptacle connector 110, three of the intermediate connectors 112 and the communication connector 120 poised for mating with each other.

In the illustrated embodiment, the connector stack 106 includes a power management connector 200 as the lowermost intermediate connector 112 configured to be coupled to the receptacle connector 110. The power management connector 200 includes the power management circuit 145 configured to be coupled to the power contacts 116 of the receptacle connector 110. The power management circuit 145 may include a surge protection component, an overvoltage protection component, an EMI filter and/or other components.

In the illustrated embodiment, the connector stack 106 includes the environmental sensor connector 128 configured to be coupled to the power management connector 200 and the lighting sensor connector 126 configured to be coupled to the environmental sensor connector 128. The communication connector 120 is configured to be coupled to the lighting sensor connector 126. Other arrangements of the connectors 108 are possible in alternative embodiments. The communication connector 120 at the top of the connector stack 106 may define the capping connector 114 used to close and seal the connector stack 106.

Figure 5:
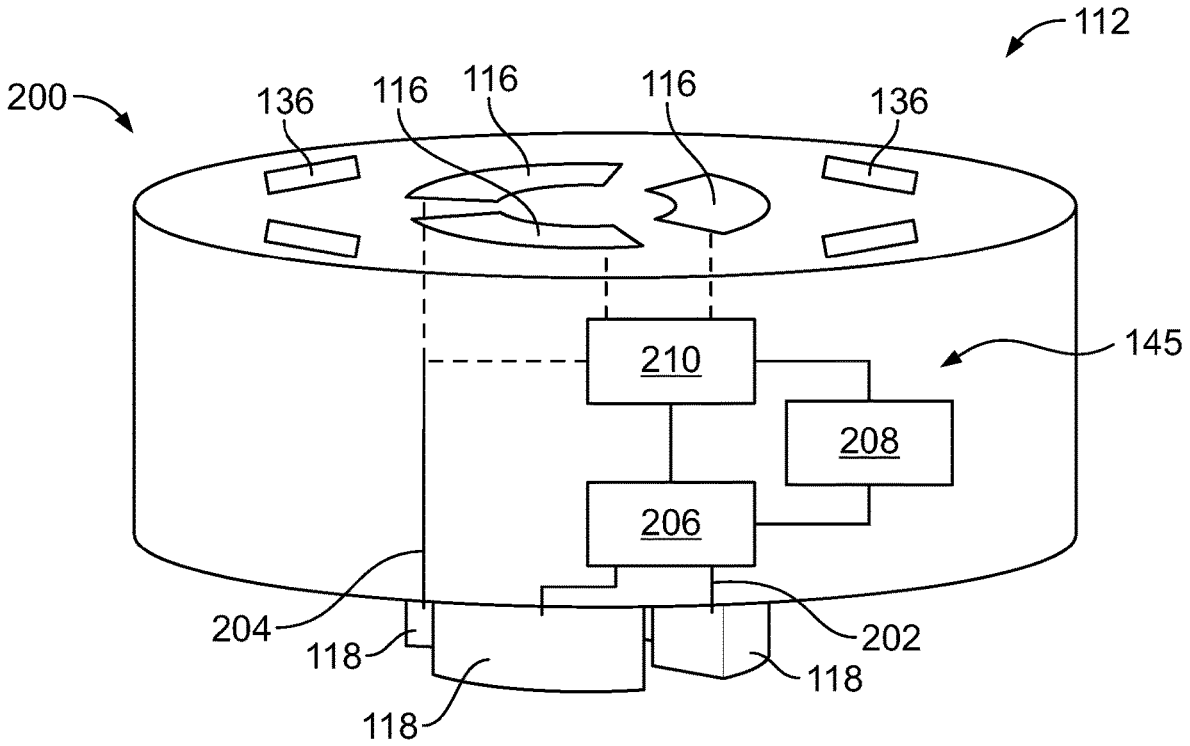
FIG. 5 is a schematic view of a power management connector in accordance with an exemplary embodiment.

FIG. 5 is a schematic view of the power management connector 200 in accordance with an exemplary embodiment. The power management circuit 145 includes a line-in circuit 202 connected to one of the power contacts 116 and a line-out circuit 204 connected to another power contact 116. The power management circuit 145 includes a surge protection component 206, an overvoltage protection component 208 and an EMI filter 210. The components are configured to be coupled to corresponding power contacts 116 and power contacts 118. The power management circuit 145 may be connected to another intermediate connector 112 mated to the upper mating interface of the power management connector 200.

Figure 6:
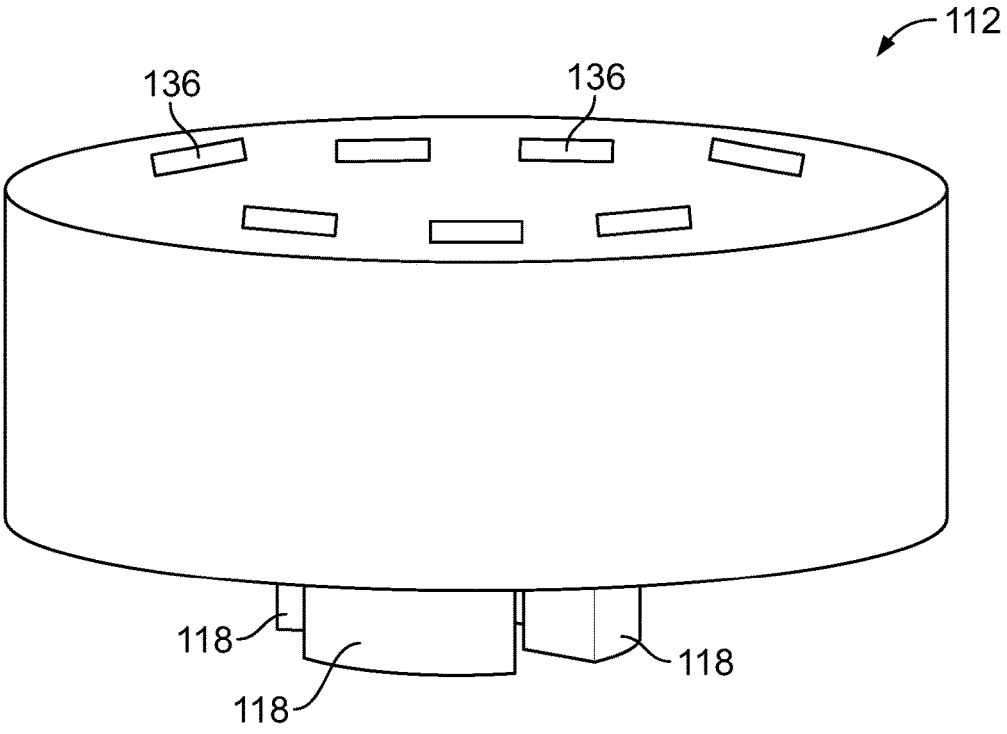
FIG. 6 is a perspective view of an intermediate connector in accordance with an exemplary embodiment.

FIG. 6 is a perspective view of one of the intermediate connector 112 in accordance with an exemplary embodiment. The intermediate connector 112 includes the power contacts 118 at the bottom, but does not include the power contacts 118 at the top. The upper mating interface includes a plurality of the signal contacts 136. Other intermediate connectors 112 coupled to the illustrated intermediate connector 112 would not include the power contacts 118, but rather would have signal contacts arranged in a complementary interface as the upper mating interface for electrical connection to the illustrated intermediate connector 112.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A sensor element for a local luminaire area (LLA) control system comprising:

a receptacle connector including a receptacle connector housing having a base configured to be mounted to a light fixture and a receptacle connector mating interface opposite the base, the receptacle connector holding power contacts for electrical connection with power wires for powering the light fixture;

a lighting sensor connector separate and discrete from the receptacle connector, the lighting sensor connector including a lighting sensor connector housing having a base configured to be mounted to the receptacle connector mating interface, the lighting sensor connector having a lighting sensor connector mating interface opposite the base, the lighting sensor connector having a photocontrol component for sensing an ambient light exterior of the sensor element for use by the LLA control system for controlling the light fixture;

an environmental sensor connector separate and discrete from the lighting sensor connector, the environmental sensor connector including an environmental sensor connector housing having a base configured to be mounted to the lighting sensor connector mating interface, the environmental sensor connector having an environmental sensor component for sensing an environmental characteristic other than ambient light exterior of the sensor element for use by the LLA control system; and a communication module operably coupled to at least one of the photocontrol component or the environmental sensor component to communicate sensor data from the corresponding photocontrol component or the environmental sensor component to at least one of a light fixture communication device in the light fixture or a remote communication device remote from the light fixture;

wherein the receptacle connector, the lighting sensor connector and the environmental sensor connector are arranged in a connector stack coupled to each other and stacked on the light fixture.

2. The LLA control system of claim 1, wherein the receptacle connector is a twist lock connector, the lighting sensor connector is a twist lock connector configured to be rotatably coupled to the receptacle connector, the environmental sensor connector is a twist lock connector configured to be rotatably coupled to the lighting sensor connector.

3. The LLA control system of claim 1, wherein the lighting sensor connector includes power contacts electrically connected to the power contacts of the receptacle connector.

4. The LLA control system of claim 3, wherein the power contacts of the receptacle connector are twist lock power contacts and the power contacts of the lighting sensor connector are twist lock power contacts.

5. The LLA control system of claim 3, wherein the environmental sensor connector includes power contacts electrically connected to the power contacts of the lighting sensor connector.

6. The LLA control system of claim 1, wherein the environmental sensor connector is a first environmental sensor connector, the sensor element further comprising a second environmental sensor connector arranged in the connector stack between the lighting sensor connector and the first environmental sensor connector.

7. The LLA control system of claim 1, wherein the communication module is configured for contactless communication with the at least one of the light fixture communication device or the remote communication device.

8. The LLA control system of claim 1, wherein the communication module is contained in either the lighting sensor connector housing or the environmental sensor connector housing.

9. The LLA control system of claim 1, wherein the sensor element further comprises a communication connector having a communication connector housing holding the communication module, the communication connector being coupled to at least one of the receptacle connector, the lighting sensor connector and the environmental sensor connector.

10. The LLA control system of claim 1, wherein the receptacle connector comprises signal contacts at the receptacle connector mating interface, the lighting sensor connector having signal contacts at the base electrically connected to the signal contacts of the receptacle connector.

11. The LLA control system of claim 10, wherein the environmental sensor connector comprises signal contacts at the base electrically connected to the signal contacts of the lighting sensor connector.

12. The LLA control system of claim 1, wherein the receptacle connector housing, the lighting sensor connector housing and the environmental sensor connector housing are cylindrical having substantially equal outer diameters.

13. The LLA control system of claim 1, further comprising a receptacle connector seal at the base of the receptacle connector housing configured to seal to the light fixture, the lighting sensor connector includes a lighting sensor connector seal at the base of the lighting sensor connector housing configured to seal to the receptacle connector, the environmental sensor connector includes an environmental sensor connector seal at the base of the environmental sensor connector housing configured to seal to the lighting sensor connector.

14. The LLA control system of claim 1, wherein the receptacle connector includes a power management circuit coupled to the power contacts having a surge protection component and an overvoltage component.

15. The LLA control system of claim 1, further comprising an outer housing having a cavity receiving the connector stack, the outer housing having a mating interface configured to be seated on the light fixture.

16. The LLA control system of claim 1, further comprising a capping connector arranged at a top of the connector stack to cap and seal the connector stack.

17. The LLA control system of claim 1, wherein the environmental sensor connector includes a second environmental sensor component sensing a different environmental characteristic exterior of the sensor element for use by the LLA control system.

18. A sensor element for a local luminaire area (LLA) control system comprising:

a receptacle connector including a receptacle connector housing having a base configured to be mounted to a light fixture and a receptacle connector mating interface opposite the base, the receptacle connector holding power contacts for electrical connection with power wires for powering the light fixture, the power contacts being twist-lock power contacts;

a lighting sensor connector separate and discrete from the receptacle connector, the lighting sensor connector including a lighting sensor connector housing having a base configured to be mounted to the receptacle connector mating interface, the lighting sensor connector having a lighting sensor connector mating interface opposite the base, the lighting sensor connector having a photocontrol component for sensing an ambient light exterior of the sensor element, the lighting sensor connector having twist-lock power contacts twist-lock coupled to the twist-lock power contacts of the receptacle connector for controlling the light fixture based on the sensed ambient light by the photocontrol component; and an environmental sensor connector separate and discrete from the lighting sensor connector, the environmental sensor connector including an environmental sensor connector housing having a base configured to be mounted to the lighting sensor connector mating interface, the environmental sensor connector having an environmental sensor component for sensing an environmental characteristic other than ambient light exterior of the sensor element and generating environmental sensor data relating to the sensed environmental characteristic;

wherein the receptacle connector, the lighting sensor connector and the environmental sensor connector are arranged in a connector stack coupled to each other and stacked on the light fixture, wherein the receptacle connector is a twist lock connector, the lighting sensor connector is a twist lock connector configured to be rotatably coupled to the receptacle connector, and the environmental sensor connector is a twist lock connector configured to be rotatably coupled to the lighting sensor connector.

19. The LLA control system of claim 18, further comprising a communication module operably coupled to at least one of the photocontrol component or the environmental sensor component to communicate sensor data from the corresponding photocontrol component or the environmental sensor component to at least one of a light fixture communication device in the light fixture or a remote communication device remote from the light fixture.

20. A sensor element for a local luminaire area (LLA) control system comprising:

a receptacle connector including a receptacle connector housing having a base configured to be mounted to a light fixture and a receptacle connector mating interface opposite the base, the receptacle connector holding power contacts for electrical connection with power wires for powering the light fixture, the receptacle connector housing having mating contacts at the receptacle connector mating interface;

a sensor connector separate and discrete from the receptacle connector, the sensor connector including a sensor connector housing having a base configured to be mounted to the receptacle connector mating interface, the sensor connector having a sensor connector mating interface opposite the base, the sensor connector having a sensor component for sensing an environmental characteristic exterior of the sensor connector, the sensor connector having lower contacts at the base being electrically coupled to the mating contacts of the receptacle connector, the sensor connector having upper contacts at the sensor connector mating interface;

a capping connector separate and discrete from the sensor connector, the capping connector having a capping connector housing having a base configured to be mounted to the sensor connector mating interface, the capping connector covering the sensor connector mating interface and the upper contacts; and a communication module operably coupled to the sensor component to communicate sensor data from the sensor component to at least one of a light fixture communication device in the light fixture or a remote communication device remote from the light fixture;

wherein the receptacle connector, the sensor connector and the capping connector are arranged in a connector stack configured to be stacked on the light fixture.

* * * * *